United States Patent [19]

Yamaguchi et al.

[11] Patent Number: 4,471,690

[45] Date of Patent: Sep. 18, 1984

[54] SUPERCALENDER

[75] Inventors: Kozo S. Yamaguchi, Kobe; Masatoshi Ando, Nishinomiya, both of Japan

[73] Assignee: Kanzaki Paper Manufacturing Co., Ltd., Tokyo, Japan

[21] Appl. No.: 443,802

[22] Filed: Nov. 22, 1982

[30] Foreign Application Priority Data

Nov. 24, 1981 [JP] Japan ..... 56-188575

[51] Int. Cl.[3] ..... B30B 3/04

[52] U.S. Cl. ..... 100/162 R; 100/170

[58] Field of Search ..... 100/161, 162 R, 162 B, 100/163 A, 164, 165, 166, 168, 169, 170, 171, 172

[56] References Cited

U.S. PATENT DOCUMENTS

| | | | |
|---|---|---|---|
| 3,270,664 | 9/1966 | Venemen et al. | 100/162 R |
| 3,291,039 | 12/1966 | Christie | 100/162 R |
| 4,211,165 | 7/1980 | Schill | 100/162 R |

OTHER PUBLICATIONS

"Manual of Supercalender Operations", by Francis E. Schiller, published by Miller Freeman Publications, Inc., San Francisco in 1976, pp. 18–27.

*Primary Examiner*—Peter Feldman

*Attorney, Agent, or Firm*—Morgan, Finnegan, Pine, Foley & Lee

[57] ABSTRACT

In a supercalender at the laterally opposite sides of a driven hard roll supported for rotation at a fixed position by a frame there are arranged a pair of roll assemblies, each including at least one elastic roll and at least one hard roll detachably engageable with each other. The two roll assemblies are selectively engageable with the driven hard roll supported at a fixed position to form a series of rolls which are in contact together under pressure in such a manner that one of the roll assemblies is in an operative condition while the other roll assembly is in a rest position.

4 Claims, 3 Drawing Figures

SUPERCALENDER

BACKGROUND OF THE INVENTION

This invention relates to a supercalender and more particularly to a supercalender for smoothing the opposite surfaces of a coated paper sheet.

The supercalender, usually, comprises hard rolls (metal rolls) and elastic rolls (e.g., cotton filled rolls) alternately arranged in multi-stage, wherein the roll in the lowermost stage is driven by a drive motor for rotation, successively driving the rolls thereabove by friction. A paper sheet, when passing through the nips downwardly from the top roll, is subjected to pressure and friction whereby its opposite surfaces are finished smooth. The reason why the usual supercalender is vertically arranged in this manner is associated with an intention of effectively utilizing the accumulative downward load of rolls for smoothing purpose with each roll loading the roll immediately therebelow by its own weight.

The usual supercalender arranged vertically in this manner is used for smoothing various papers such as coated paper for printing, color developing paper for pressure-sensitive copy paper, and heat-sensitive recording paper, but has an inevitable drawback that if a mark is produced on an elastic roll during operation, the roll must be removed for repair, so that the operation must of necessity be stopped once. Where the supercalender is incorporated in a coater on an in-line basis, the operation of the coater will have to be stopped also, greatly influencing the operability. In this connection, the elastic rolls are very soft since they are made of cotton, wool, synthetic fibers, paper, asbestos, rubber, plastics or the like, and they can be easily marked if the paper is wrinkled or broken. The present situation is that even if operated with care, they have to be repaired after usually about 4–5 days of operation. If the roll mark is left as it is, this will result in the mark being reproduced on the paper during passage, thus not only detracting from the quality of the paper, but also enlarging the roll mark.

Another drawback of the usual supercalender is that it is unsuitable where a smoothing treatment under low pressure is desired. More particularly, in the case of the vertical type, since the weight of each roll is imposed on the roll immediately therebelow, the nip pressure is equal at least to the weight of the rolls. Thus, it is not suitable where a smoothing treatment is required under pressure less than the weight of the rolls.

The primary object of the invention is to provide an improved supercalender which is capable of continuous operation even if a mark is produced on an elastic roll during operation, without having to stop the operation to repair the same.

Another object of the invention is to provide an improved supercalender which is also capable of performing a smoothing operation under desired conditions at will even in cases where smoothing treatment must be performed under low nip pressure.

Other objects and advantages of the invention will be apparent from the following descriptions.

SUMMARY OF THE INVENTION

The supercalender according to the invention comprises a frame, a driven hard roll supported for rotation at a fixed position by said frame, means for driving said hard roll for rotation, a pair of roll assemblies arranged at the laterally opposite sides of said driven hard roll, respectively, each of said roll assemblies comprising at least one elastic roll and at least one hard roll detachably engageable with each other, said pair of roll assemblies being selectively engageable with said driven hard roll to form a series of rolls which are in contact together under pressure in such a manner that at least one elastic roll is inserted between two hard rolls.

In a preferred embodiment of the invention means is provided to move each of said pair of roll assemblies between the first position where said each roll assembly is urged to and engaged with said driven hard roll and the second position where said each roll assembly is retracted from said driven hard roll. Means may also be preferably provided to relatively move said elastic roll and said hard roll in each of said roll assemblies between the first position where said elastic roll and said hard roll are in contact with each other and the second position where said elastic roll and said hard roll are apart from each other.

Each of said elastic roll and said hard roll in each of said roll assemblies may be provided with its own drive means for rotation.

A PREFERRED EMBODIMENT OF THE INVENTION

Figure 1:
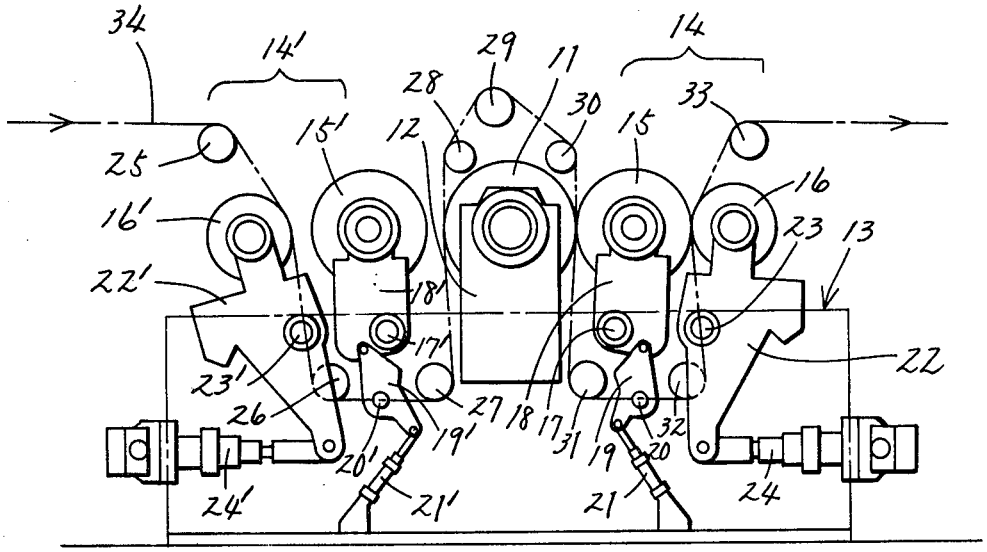
FIGS. 1 and 2 are schematic illustrations of a supercalender embodying the invention showing two different operating conditions.
Figure 2:
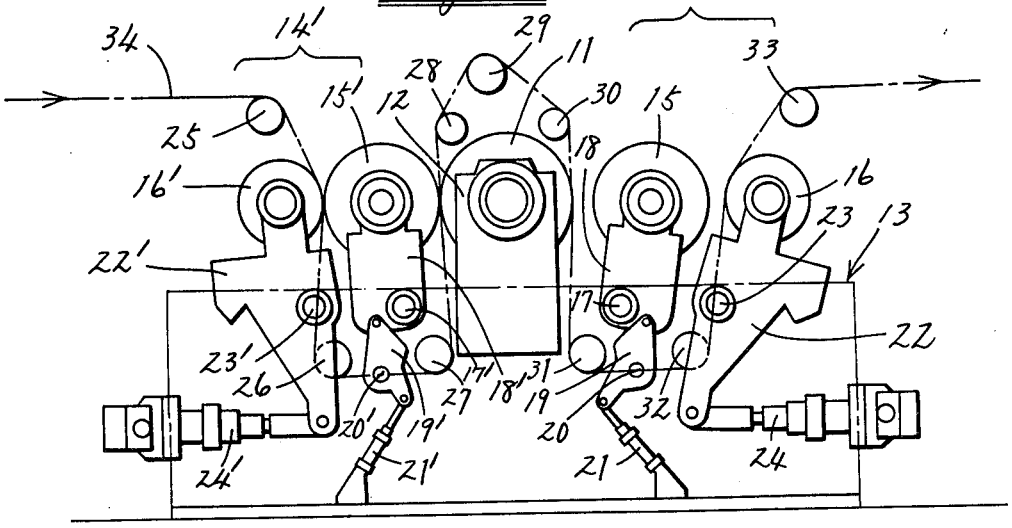

Referring to the drawings, especially to FIGS. 1 and 2, there is shown a supercalender according to the invention. The reference numeral 11 denotes a driven hard roll supported for rotation at a fixed position by support arm means 12 which is then fixedly supported by a frame 13. The driven hard roll 11 is a metal roll and mechanically connected to a drive motor (not shown) for rotating the roll 11. At the laterally or horizontally opposite sides of the driven hard roll 11 there are arranged on the frame 13 a pair of roll assemblies generally indicated by the reference numerals 14 and 14'. Each of the roll assemblies 14, 14' comprises at least one elastic roll 15, 15' and at least one hard roll 16, 16' engageable with each other. In the drawings, though there is illustrated only a pair of rolls consisting an elastic roll 15, 15' and a hard roll 16, 16' are illustrated, it should be understood that two or more pairs of rolls of the same combination or a series of rolls consisting two elastic rolls and one hard roll may also be utilized for the present invention. The hard roll 16, 16' may be a metal roll usually known as a chilled roll or a controllable crown metal roll and the elastic roll 15, 15' may be made of cotton, wool, synthetic fibers, paper, asbestos, rubber, plastics or the like.

The elastic roll 15, 15' is supported by a swing movement around a pivot 17, 17' by support arm means 18, 18'. The support arm means 18, 18' is connected via a bell crank 19, 19' having its pivot 20, 20' to an air cylinder mechanism 21, 21'. By the operation of the air cylinder mechanism 21, 21' the elastic roll 15, 15' moves or swings substantially horizontally between the first position where the elastic roll 15, 15' is urged to and engaged with the driven roll 11 and the second position where the elastic roll 15, 15' is retracted from the driven hard roll 11. When the elastic roll 15, 15' is in contact with the driven hard roll 11, the elastic roll 15, 15' is driven in the manner of a surface drive by the hard roll 11. The pivots 17 and 20 are supported by the frame 13.

The hard roll 16, 16' is supported by support arm means 22, 22' having its own pivot 23, 23'. The support arm means 22, 22' is connected to an air cylinder mechanism 24, 24'. By the operation of the air cylinder mechanism 21, 21' the hard roll 16, 16' moves or swings substantially horizontally between the first position where the shiftable hard roll 16, 16' is urged to and engaged with the driven hard roll 11 via the elastic roll 15, 15' and the second position where the shiftable hard roll 16 is apart from the elastic roll 15, 15' which takes its retracted position where the elastic roll 15, 15' is apart from the driven hard roll 11.

The two roll assemblies 14 and 14' are selectively engageable with the driven hard roll 11. FIG. 1 illustrates the state where the first roll assembly 14 is in the operative condition with the three rolls 11, 15 and 16 being in contact in series under pressure while the second roll assembly 14' is kept in rest with the elastic roll 15' being apart from each of the two hard rolls 11 and 16'. FIG. 2 illustrates the reversed state. Since the power of the air cylinder mechanism 24, 24' is larger than that of the air cylinder mechanism 21, 21', the nip pressure between the driven hard roll 11 and the elastic roll 15, 15' and the nip pressure between the elastic roll 15, 15' and the shiftable hard roll 16, 16' may substantially depend on the pressure supplied by the air cylinder mechanism 24, 24'. The two air cylinder mechanisms 21 and 24, or 21' and 24' may be operatively connected in such a manner that the elastic roll 15, 15' may only be retracted from the driven hard roll 11 when and after the hard roll 16, 16' takes its most retracted position as shown in FIG. 1 for the hard roll 16, or in FIG. 2 for the hard roll 16'.

The reference numerals 25, 26, 27, 28, 29, 30, 31, 32, 33 indicate guide rollers for a coated paper sheet 34 to be subjected to a calendering treatment.

The elastic roll 15, 15' and the hard roll 16, 16' may be driven for rotation by the surface drive from the driven hard roll 11 when they are in contact in series with the driven hard roll 11.

Each of the elastic rolls 15, 15' and the hard rolls 16, 16' may be provided with its own drive means for rotation so that any rotation lag which may take place owing to slipping in the nips can be compensated for.

Figure 3:
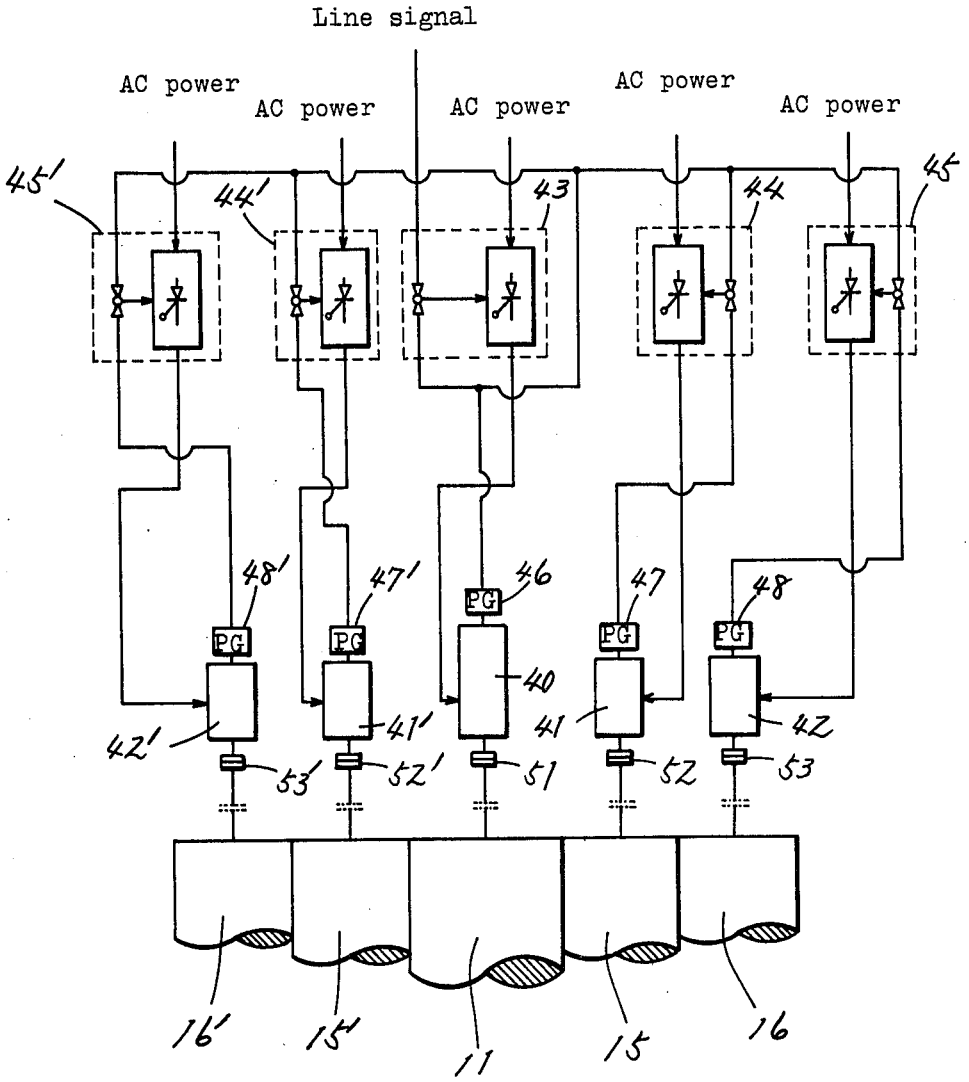
FIG. 3 illustrates a preferred manner for operatively controlling the drive of a series of rolls of the supercalender according to the invention.

A preferred method of operation of the supercalender according to the invention will now be described in more detail with reference to FIG. 3. The drive DC motors 40, 41, 41', 42 and 42' for the respective rolls 11, 15, 15', 16, 16' are supplied with a current in DC form converted from a AC power source through controllers 43, 44, 44', 45 and 45'. In the driven hard roll 11, a line speed signal (in the case of installation in a coater on an in-line basis, a speed signal from the coater) and the speed of the pulse generator 46 of the DC motor 40 for the hard roll 11 are compared with each other at all times to send a signal to the controller 43 indicating whether or not it is in harmony with the line speed, whereby it is controlled so that it is in harmony with the line speed.

On the other hand, the elastic roll 15, 15' and the hard roll 16, 16' are controlled by the controllers 44, 44' and 45, 45' by sending a signal indicating the speed of the hard roll 11 and a signal from the pulse generator 46 of the DC motor 40 for the hard roll 11 and comparing signals indicating the speeds of the pulse generators 47, 47' and 48, 48' of the DC motors 41, 41' and 42, 42' for the elastic rolls 15, 15' and the hard rolls 16, 16', so as to ensure in harmony with the hard roll 11. The reference numerals 51, 52, 52' 53 and 53' indicate couplings inserted between the motors 40, 41, 41', 42 and 42' and the rolls 11, 15, 15' 16 and 16', respectively.

Therefore, when this supercalender is operated with a line pressure where the nip pressure is low, the friction between the rolls 11, 15 and 16, or 11, 15' and 16' is low because of low nip pressure applied and hence the elastic rolls 15, 15' and the hard rolls 16, 16' are operated by the combination of a surface drive from the hard roll 11 and a central drive produced by their own drive motors 41, 41' and 42, 42'.

In cases where the nip pressure is high, since the friction between the rolls 11, 15 and 16 or 11, 15', 16' is high, the torque for rotation of the elastic rolls 15, 15' and the hard rolls 16, 16' is low, thus hardly requiring the utilization of the drive motors 41, 41' and 42, 42'.

Thus, in performing a smoothing treatment by passing a paper sheet through the aforesaid supercalender, the group of rolls 15, 16 disposed on one side (in FIG. 1, right-hand side) of the hard roll 11 will be used with the rolls contacted with each other. During this while, the group of rolls 15', 16' disposed on the other side (in FIG. 1, left-hand side) are at rest with the rolls separated from each other.

If a mark is produced on the elastic roll 15 on the right-hand side, the rolls 15 and 16 on the right-hand side are separated from the hard roll 11, as shown in FIG. 2, and at the same time the left-hand side roll group 14' which is at rest is brought into contact with the hard roll 11, thus switching calendering from right to left. During this while, the marked roll 15 on the right-hand side is removed and repaired. Therefore, the right-hand side roll group 14 comes to rest. Thus, in the supercalender of the present invention, the right- and left-hand sides 14 and 14' can be alternately used.

With the supercalender of the invention arranged in the manner described above, it is effective particularly where a smoothing treatment with low pressure is required. For example, in the case of heat-sensitive recording paper, it is preferable from the standpoint of quality that the recording surface be smooth. However, from the standpoint of the naturalness of paper, it is desirable that it be free from high gloss and color development contamination (fog) and be high in brightness. To meet such requirements, it is most preferable to perform the smoothing treatment by the supercalender of the present invention.

That is, since the supercalender of the invention has rolls installed in horizontal style, it follows that the nip pressure is only the pressure of contact from the lateral side. In other words, since the weight of the rolls has nothing to do with the nip pressure, it is possible to make the nip pressure lower than the weight of the rolls. Thus, this is very convenient where it is sufficient to simply level the surface or where such degree of treatment must be maintained.

For example, in the case of smoothing heat-sensitive recording paper having high recording sensitivity, this cannot be done by the conventional vertical type supercalender without entailing fog. There is a tendency for heat-sensitive recording paper to go further toward higher sensitivity, and smoothing in that case requires supercalendering with a nip pressure which must of necessity be low. For this purpose the supercalender of the present invention is most suitable. Further, in heat-sensitive recording paper of high sensitivity, fog is liable to occur if there is friction in the nips. In such case, friction can be avoided by operating the respective drive motors with which the elastic rolls 15, 15' and hard rolls 16, 16' are provided. However, in cases where it is necessary to positively utilize friction for coated papers other than heat-sensitive recording paper, this requirement can be met by stopping the operation of those drive motors and making the use of the surface drive from the hard roll 11 alone.

As has been described so far, the supercalender of the present invention is arranged so that as shown in FIGS. 1 and 2 the right-hand side roll group 14 and the left-hand side roll group 14' can be alternately used. As a result, even if an elastic roll 15, 15' is marked, the operation can be continued by the rolls group on the other side, during which time the marked roll can be repaired, thus enabling the operation to continue without lowering the operating efficiency. Another superior effect is that smoothing treatments ranging from high to low nip pressures can be performed as desired.

What is claimed is:

1. A supercalender comprising a frame, a driven hard roll supported for rotation at a fixed position by said frame, means for driving said hard roll for rotation, a pair of roll assemblies arranged at the laterally opposite sides of said driven hard roll, respectively, each of said roll assemblies comprising at least one elastic roll and at least one hard roll arranged in a substantially horizontal direction and detachably engageable with each other, said pair of roll assemblies being selectively engageable with said driven hard roll to form a series of rolls which are in contact together under pressure in such a manner that at least one elastic roll is inserted between two hard rolls and all engaging rolls are arranged in a substantially horizontal direction.

2. A supercalender as defined in claim 1 in which means is provided to move each of said pair of roll assemblies between a first position where said each roll assembly is urged to and engaged with said driven hard roll and a second position where said each roll assembly is retracted from said driven hard roll.

3. A supercalender as defined in claim 2 in which means is provided to relatively move said elastic roll and said hard roll in each of said roll assemblies between the first position where said elastic roll and said hard roll are in contact with each other and the second position where said elastic roll and said hard roll are apart from each other.

4. A supercalender as defined in claim 1 in which each of said elastic roll and said hard roll in each of said roll assemblies is provided with its own drive means for rotation.

* * * * *